US006171203B1

(12) United States Patent
Huang

(10) Patent No.: US 6,171,203 B1
(45) Date of Patent: Jan. 9, 2001

(54) STRUCTURE OF GOLF PUTTER HEAD

(76) Inventor: Chun-Yao Huang, No. 7, Alley 46, Lane 329, Ya-Tan Rd., San-He Village, Ta-Ya Hsiang, Taichung Hsien (TW)

( * ) Notice: Under 35 U.S.C. 154(b), the term of this patent shall be extended for 0 days.

(21) Appl. No.: 09/328,376

(22) Filed: Jun. 9, 1999

(51) Int. Cl.[7] ..... A63B 53/02; A63B 53/04

(52) U.S. Cl. ..... 473/305; 473/307; 473/313; 473/340; 473/342

(58) Field of Search ..... 473/305, 306, 473/307, 308, 309, 310, 311, 312, 313, 314, 315, 324, 342, 288, 251, 244, 242, 245, 246, 247, 223, 350, 325, 341, 340

(56) References Cited

U.S. PATENT DOCUMENTS 4,111,426 * 9/1978 Goodwin .
4,121,832 * 10/1978 Ebbing .
4,506,888 * 3/1985 Nardozzi .
4,872,685 * 10/1989 Sun .
5,437,447 * 8/1995 Rigutto .
5,547,427 * 8/1996 Rigal .
5,749,790 * 5/1998 Alen .
5,776,011 * 7/1998 Su .
5,863,257 * 1/1999 Busnardo .
5,899,817 * 5/1999 Dunikoski .
5,938,543 * 8/1999 McGeeney .

* cited by examiner

*Primary Examiner*—Sebastiano Passaniti
(74) *Attorney, Agent, or Firm*—Dougherty & Troxell

(57) ABSTRACT

This invention provides a new structure of golf putter head by integral molding a striking board and a neck portion with a light material. After the striking board and the neck portion are inserted in a concave coupling portion of a putter head, the two-in-one composition will not move the center of gravity A upwards but keeps it in the same horizontal level with that of a golf ball (B) to facilitate easy grasp of the sweet spot in a strike.

4 Claims, 12 Drawing Sheets

STRUCTURE OF GOLF PUTTER HEAD

BACKGROUND OF THE INVENTION

A decent golf club to a golfer is something just like a good brush to a painter in some respects, at least, both require delicate skills that can only be accumulated and upgraded by constant practice.

As the putting green is usually the main battlefield, in addition to skill and experience, a good putter is also an important factor in striving for award. Besides the material a putter is made of, a low gravity center at the same height with the ball center is considered a must for the putter to enable a player to tap at the ball center without offset. Various patented structures of golf putter are briefly described with annexed diagrams as below:

1. According to a disclosed Taiwan patent No. 117286 (shown in FIG. 1), an integrally molded golf putter head 1 with a neck 10 for insertion of a shaft 11 has a center of gravity A at a position higher than the center of gravity B of a golf ball (shown in FIG. 2) for reason that the putter head 1 and the neck 10 are molded integrally of the same material. Hence, a cavity on back of the putter head 1 is required to accommodate an extra weight for lowering the center of gravity A to coincide with center of gravity B that makes the fabrication process difficult.

2. According to another disclosed Taiwan patent No. 303710 (shown in FIG. 3), a putter head 2 and a neck 20 are separately fabricated. When assembling, the neck 20 is inserted in the putter head 2 firstly, then coupled with a shaft 21. In this structure, after the neck 20 bent in an angle is combined with the putter head 2, the center of gravity A is liable to deviate from the center of gravity B in a golf ball (as shown in FIG. 4), so that the putting accuracy may be affected.

3. According to a further disclosed Taiwan patent No. 271622 (shown in FIG. 5), plural tapped holes 30 are disposed in a putter head 3, wherein a tapped hole 30 may be selected for screw-fixing a neck 31, which then couples with a shaft 32, in order to adjust offset of the center of gravity A in the putter head 3 (shown in FIG. 6). However, in such a structure, the screw-fixing component N for anchoring the neck 31 to the putter head 3 will probably get loosened later on after some period of time to thus deviate angle of screw joint and incur offset of the center of gravity A in the putter head 3 to miss the sweet spot in a strike.

In view of the above-described imperfections, after years of constant effort in research, the inventor of this invention has consequently developed and proposed this improved mechanism pertaining to the subject matter.

SUMMARY OF THE INVENTION

This invention relates to a new structure of a golf putter, particularly to a putter head, wherein a striking board and heel of a neck can be inserted in a recess of the putter head. As the striking board and the neck are molded integrally with a light material, the center of gravity of the putter head can be lowered for grasping the sweet spot.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THIS INVENTION

The primary object of this invention is to provide a golf putter with a low center of gravity in putter head.

Figure 1:
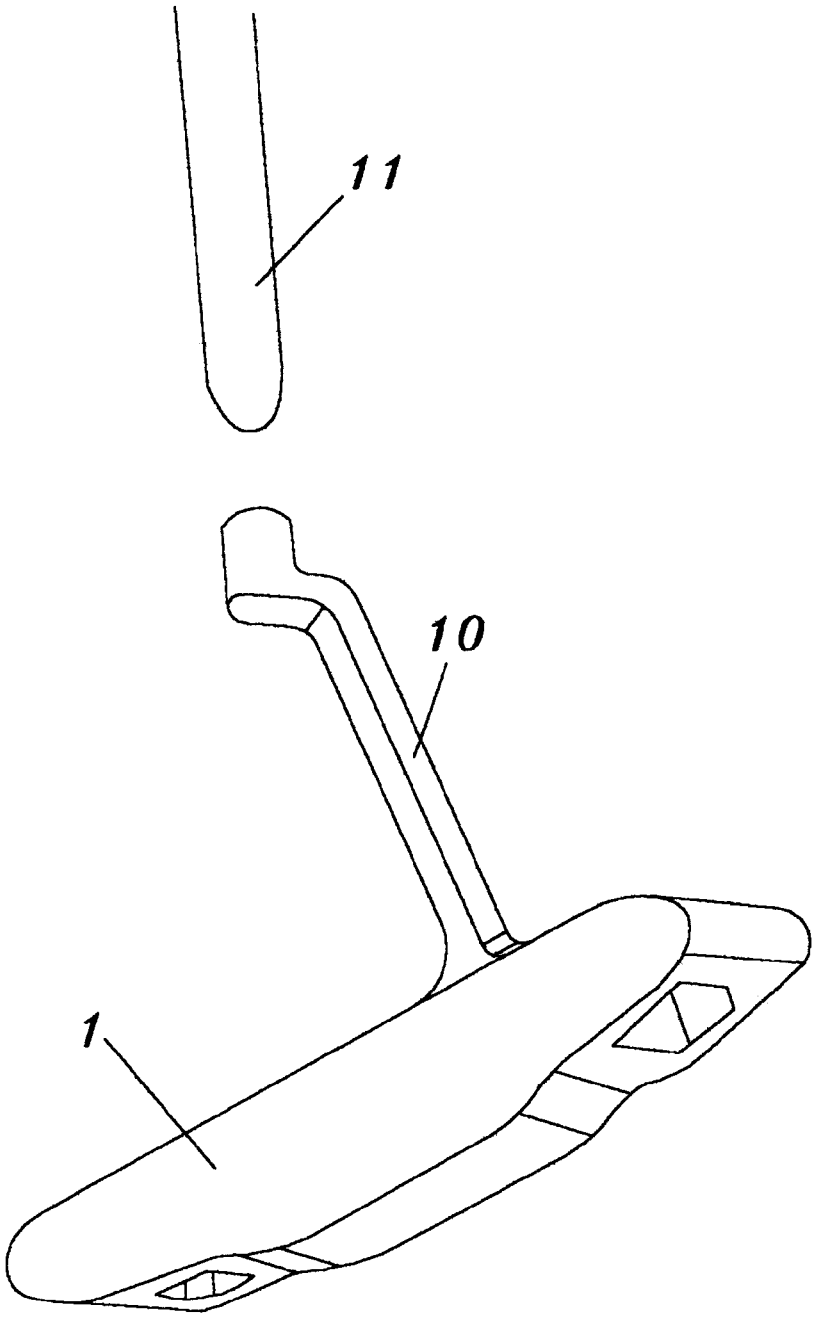
FIG. 1 PRIOR ART
FIG. 1 is a three-dimensional exploded view of a prior golf putter (1)
Figure 2:
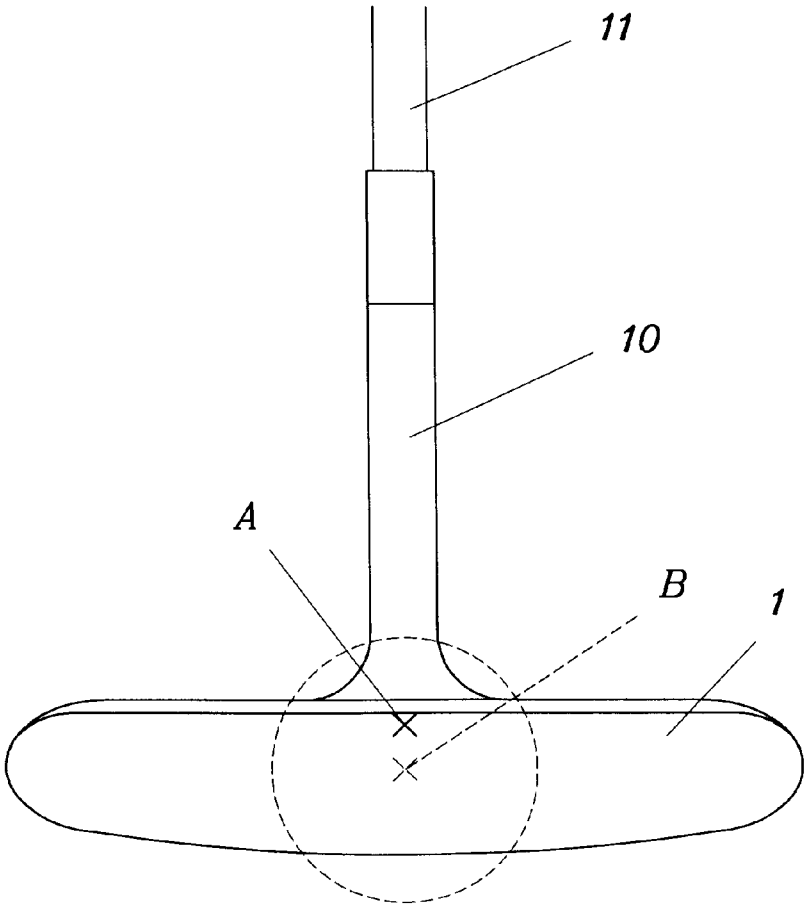
FIG. 2 PRIOR ART
FIG. 2 is a schematic view showing a center of gravity of the FIG. 1 and a golf ball respectively.
Figure 3:
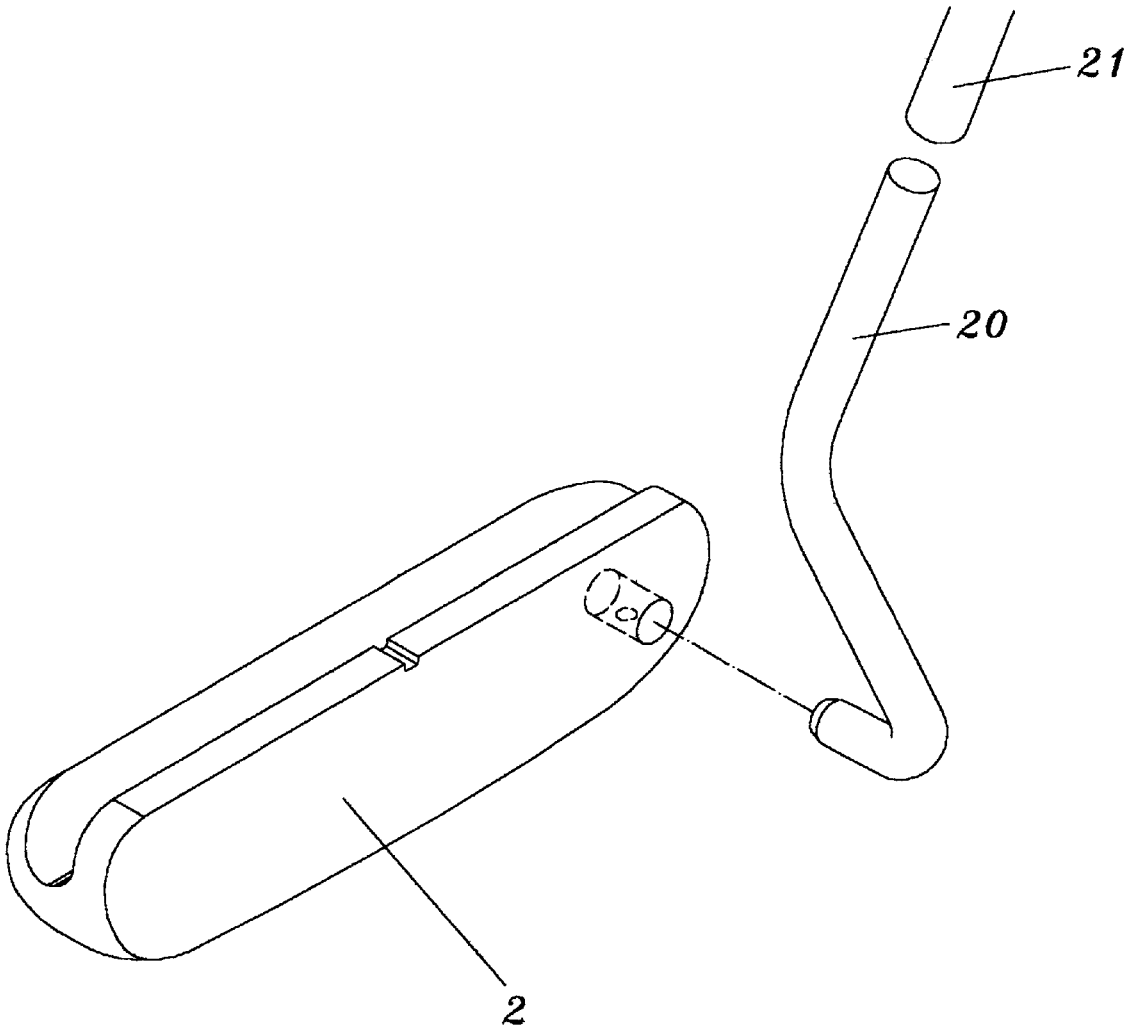
FIG. 3 PRIOR ART
FIG. 3 is another three-dimensional exploded view of prior golf putter.
Figure 4:
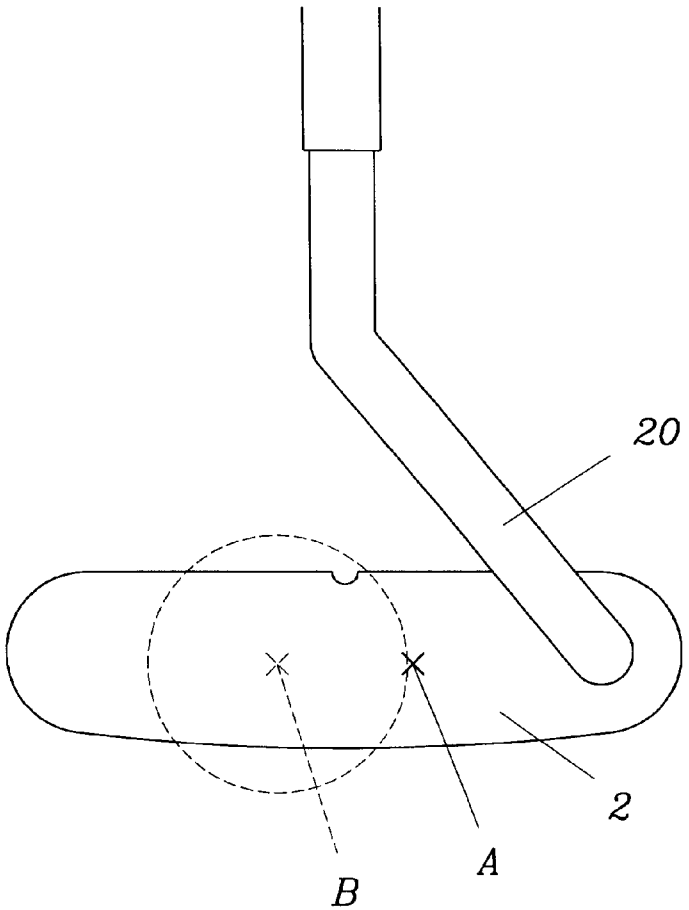
FIG. 4 PRIOR ART
FIG. 4 is a schematic view showing a center of gravity of the FIG.3 and the golf ball respectively.
Figure 5:
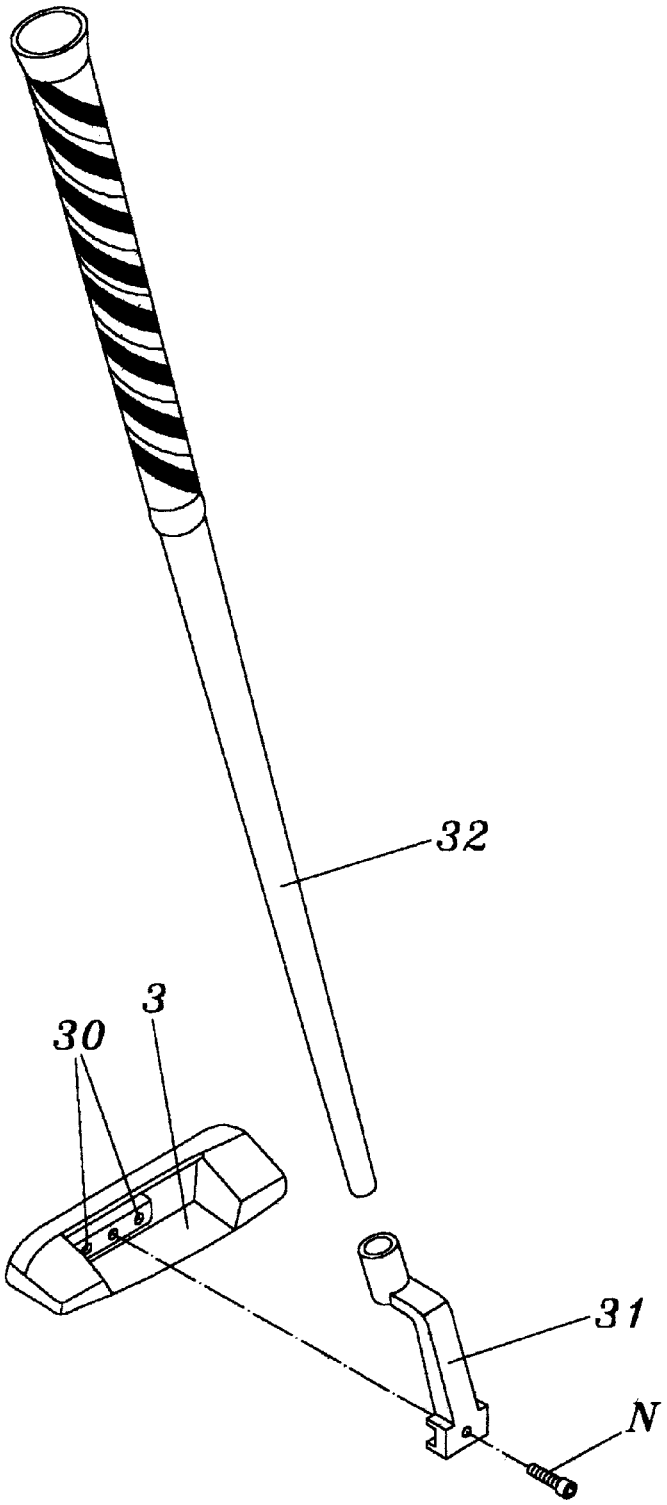
FIG. 5 PRIOR ART
FIG. 5 is another three-dimensional exploded view of prior golf putter.
Figure 6:
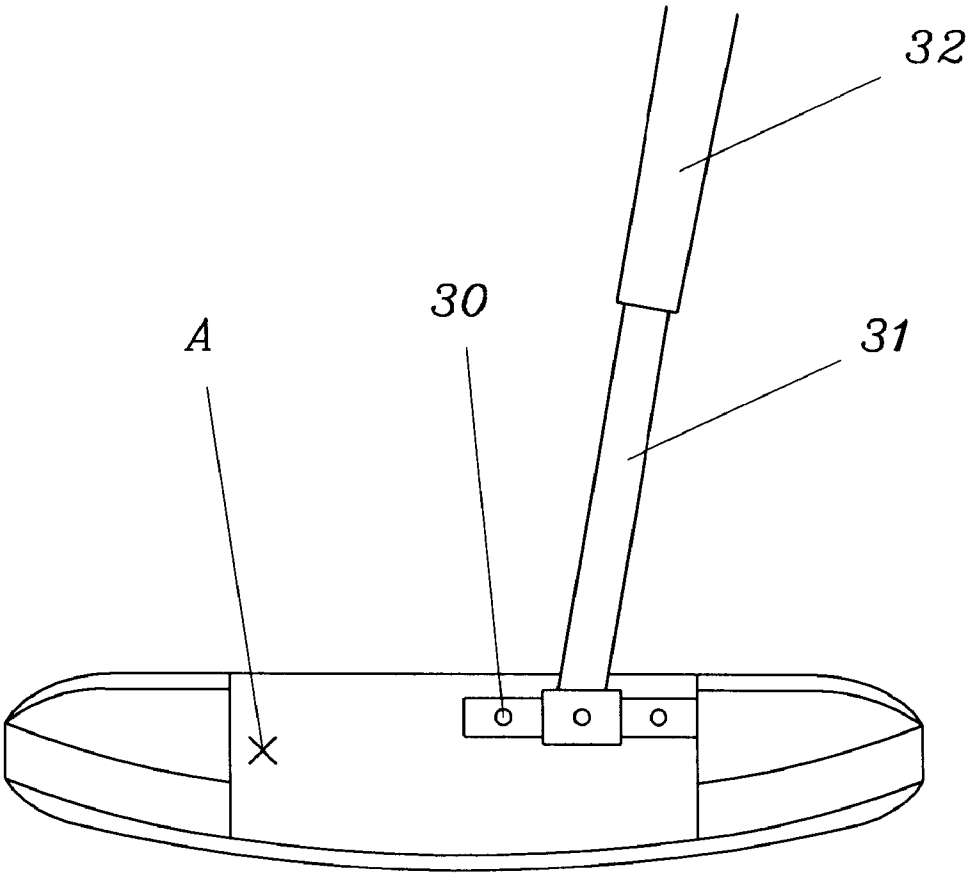
FIG. 6 PRIOR ART
FIG. 6 is a three-dimensional assembled view of the FIG. 6.
Figure 7:
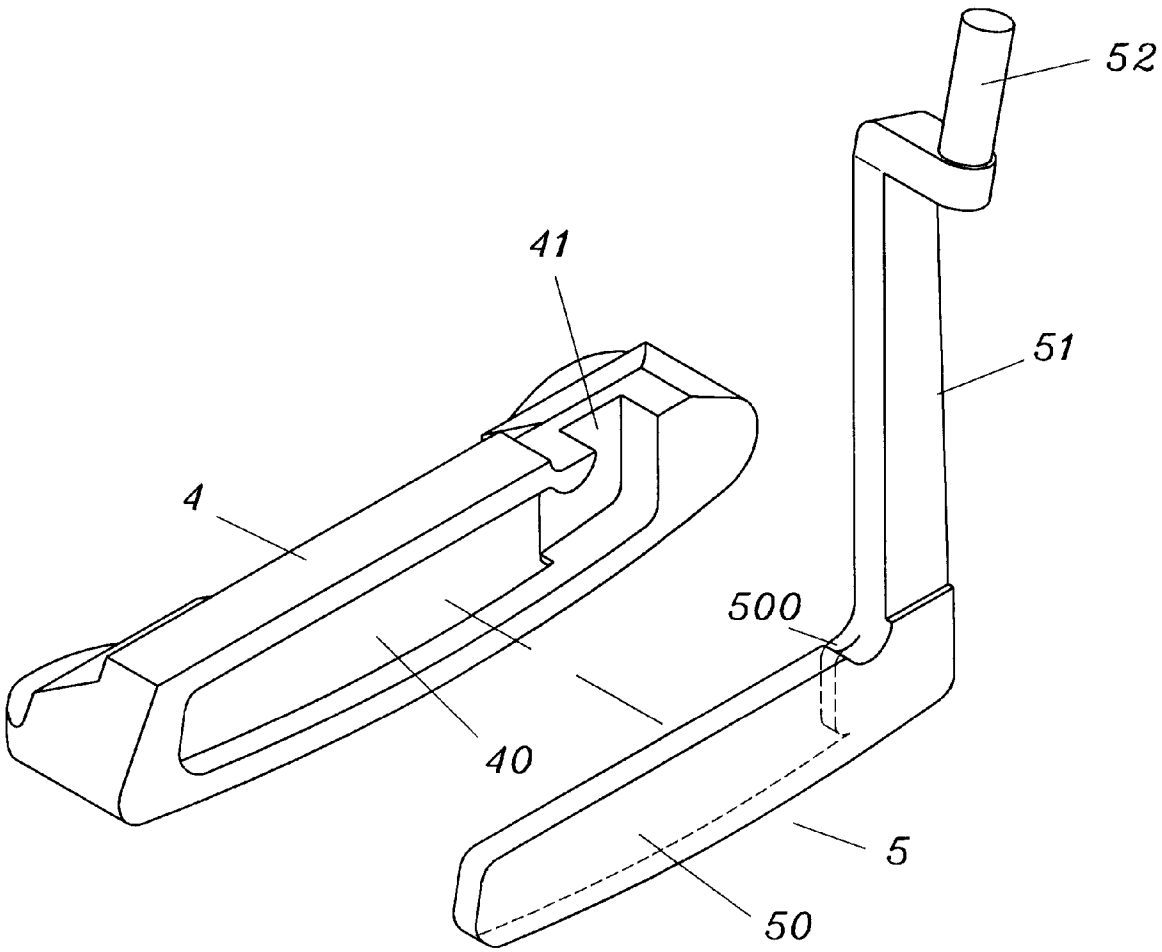
FIG. 7 is a three-dimensional exploded view of this invention.

With regard to abovesaid object and efficacy of this invention, at least a preferred embodiment will be elucidated with annexed diagrams as below:

Firstly, as shown in FIG. 7, this invention mainly comprises a putter head 4 having a concave coupling portion 40 disposed in its front face, wherein an insertion recess 41 is formed communicatively at right hand (see FIG. 7) to the concave coupling portion 40; a striking piece 5 made of a light material is inserted in the concave coupling portion 40, wherein a striking board 50 is disposed in a front face of the striking piece 5, and an insertion protrusion 500 is formed at right side on back of the striking board 50 for cooperation with the insertion recess 41 in the putter head 4, and moreover, the insertion protrusion is extended upwards to form a neck portion 51, which is provided on its top with an insertion sleeve 52.

Figure 8:
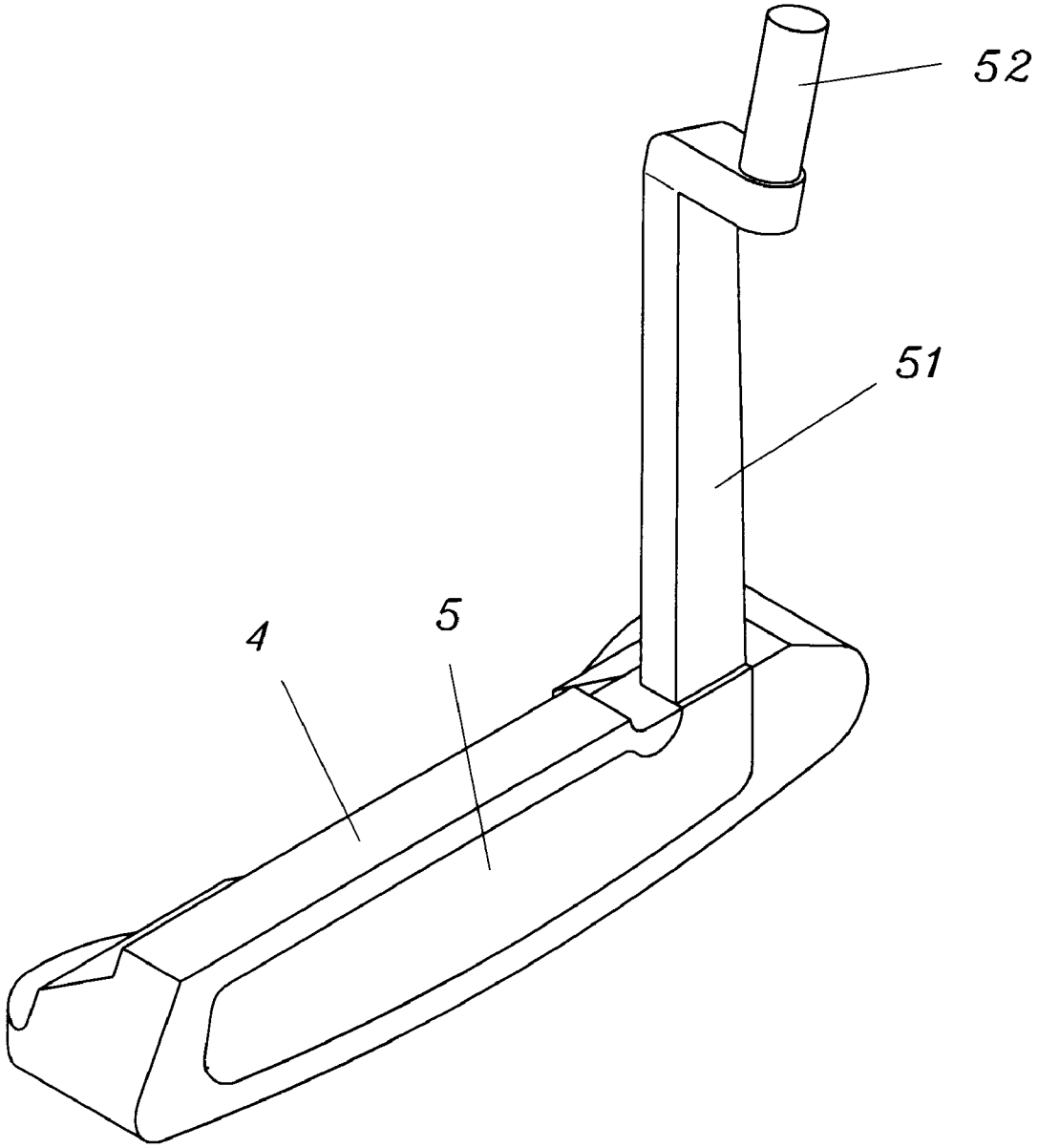
FIG. 8 is a three-dimensional assembled view of this invention.
Figure 9:
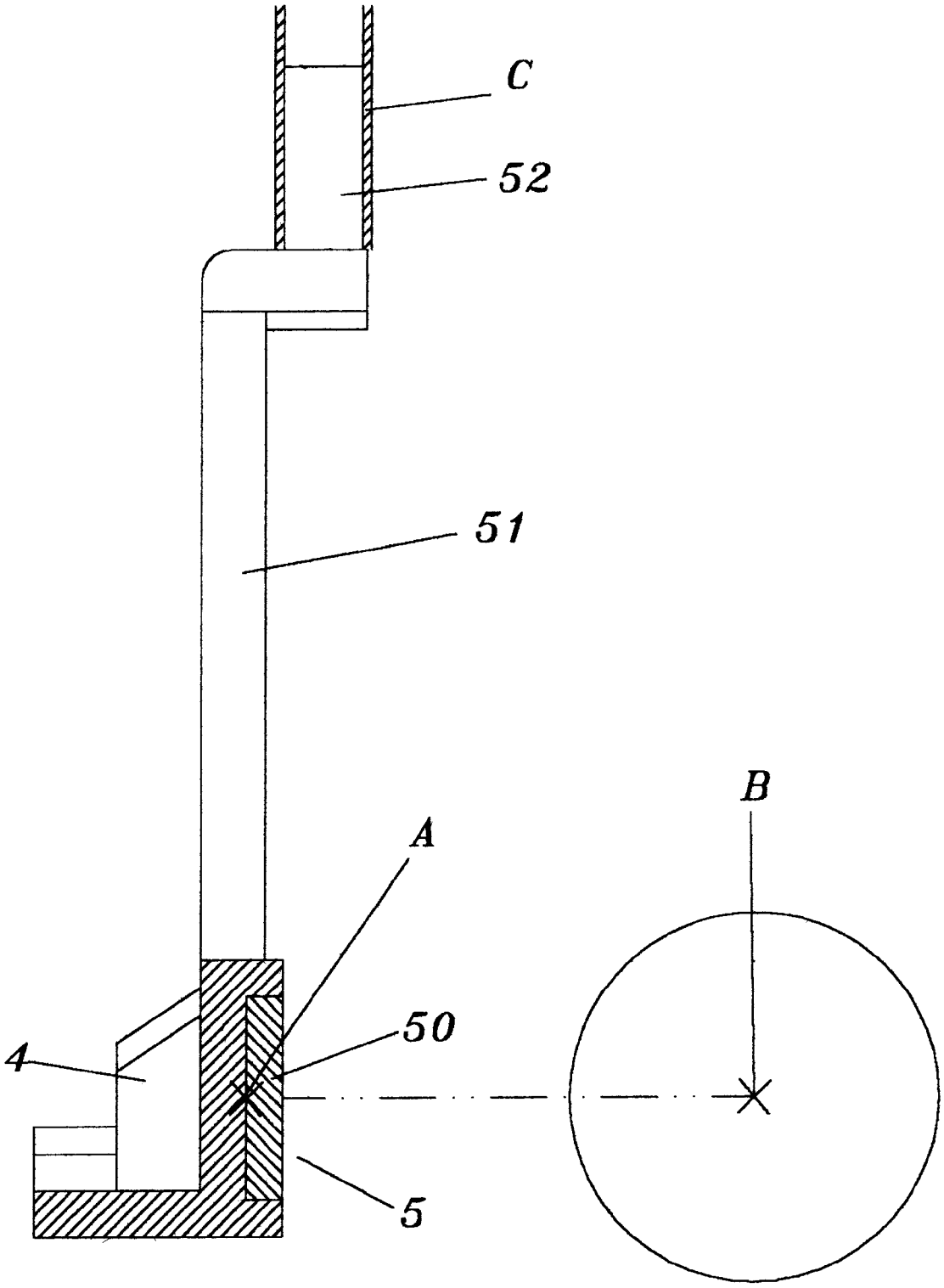
FIG. 9 is a schematic view showing a center of gravity of this invention and the golf ball respectively.

When assembling, as shown in FIG. 8, the striking board 50 of the striking piece 5 is to be inserted in the concave coupling portion 40 of the putter head 4 to combine two pieces in one, then a club shaft C is inserted in the insertion sleeve 52 to form a complete putter. Due to integral molding of the striking board 50 and the neck portion 51, the center of gravity of the putter head 4 can be lowered down to stand at the same horizontal level with the center of gravity B in a golf ball for easy alignment of the sweet spot as shown in FIG. 9.

Figure 10:
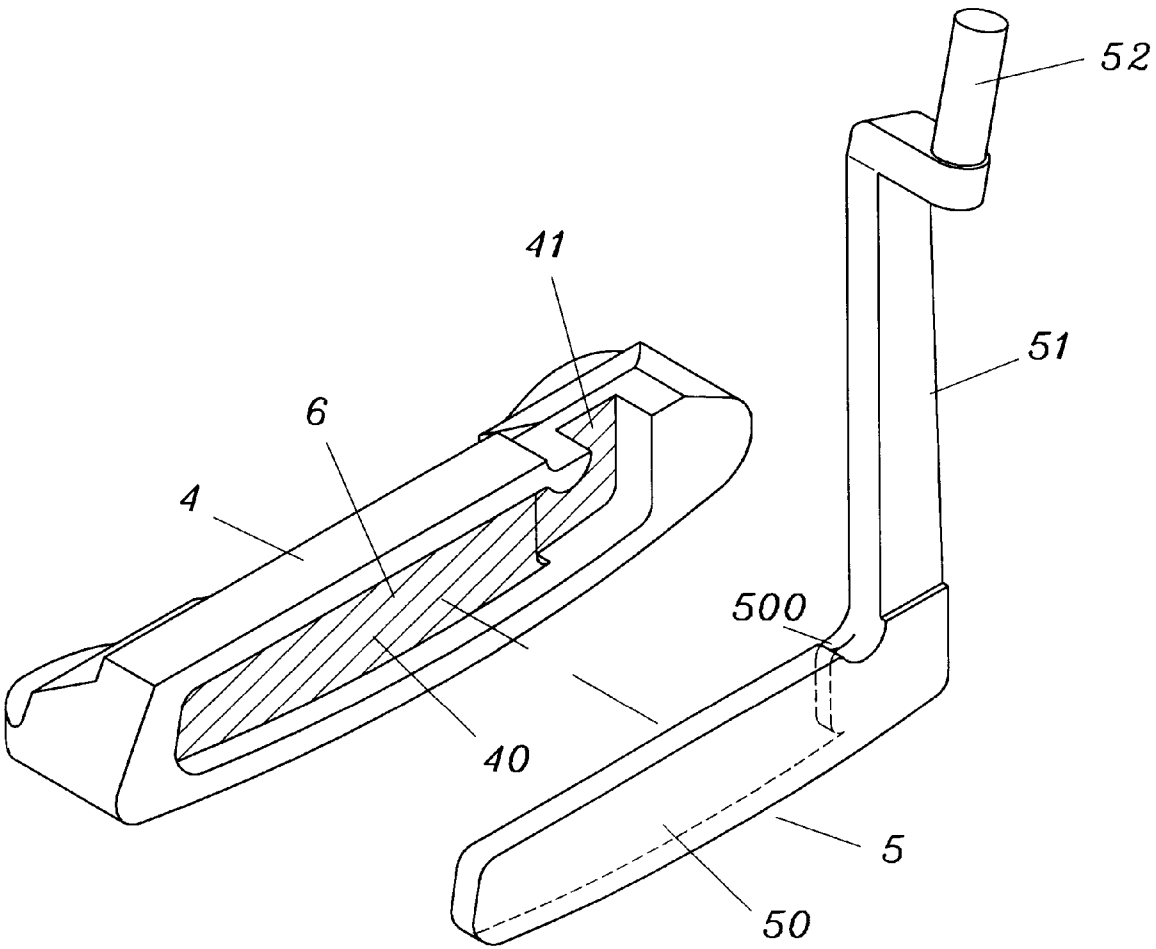
FIG. 10 is a three-dimensional exploded view of another embodiment of this invention.

Another embodiment of this invention is shown in FIG. 10, wherein the concave coupling portion 40 and the insertion recess 41 of the putter head 4 are glued with a layer of binder 6, and the striking board 50 is then bound in the concave coupling portion 40 and the insertion recess 41 of the putter head 4 to achieve the same efficacy of two-in-one.

Figure 11:
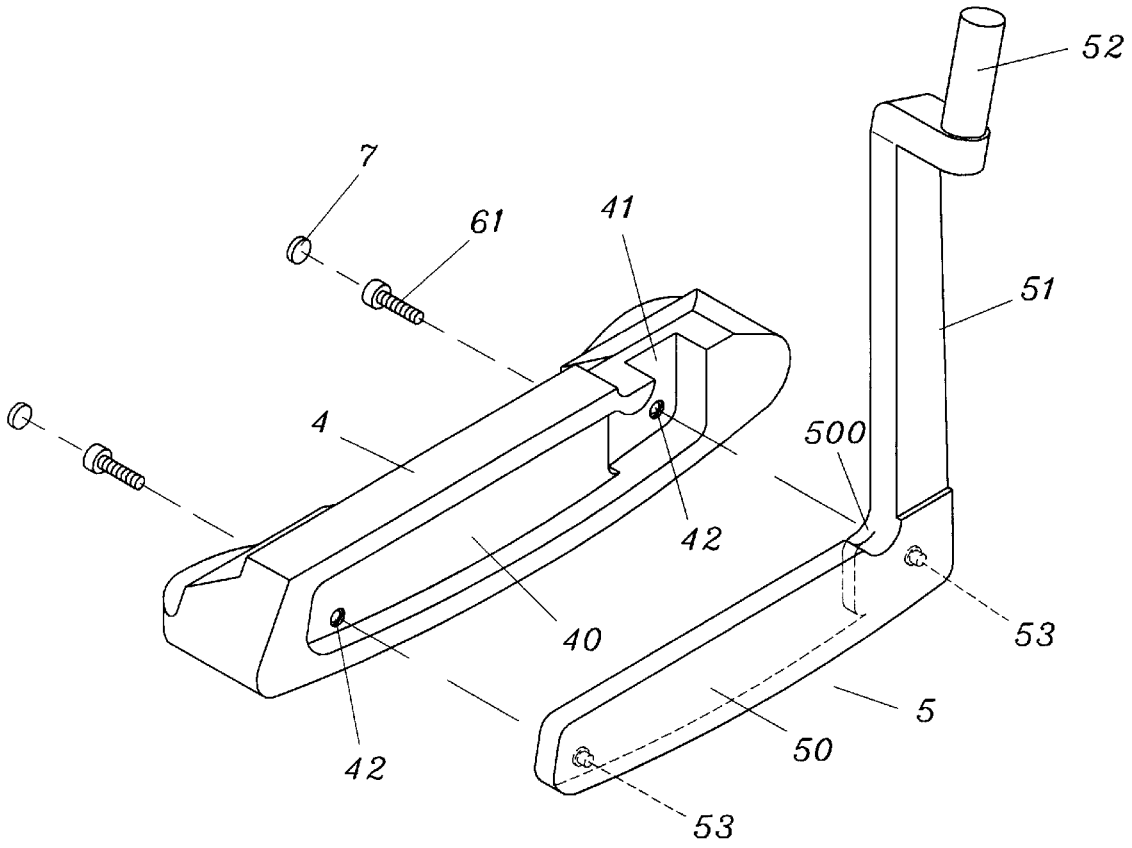
FIG. 11 is a three-dimensional exploded view of a further embodiment of this invention.
Figure 12:
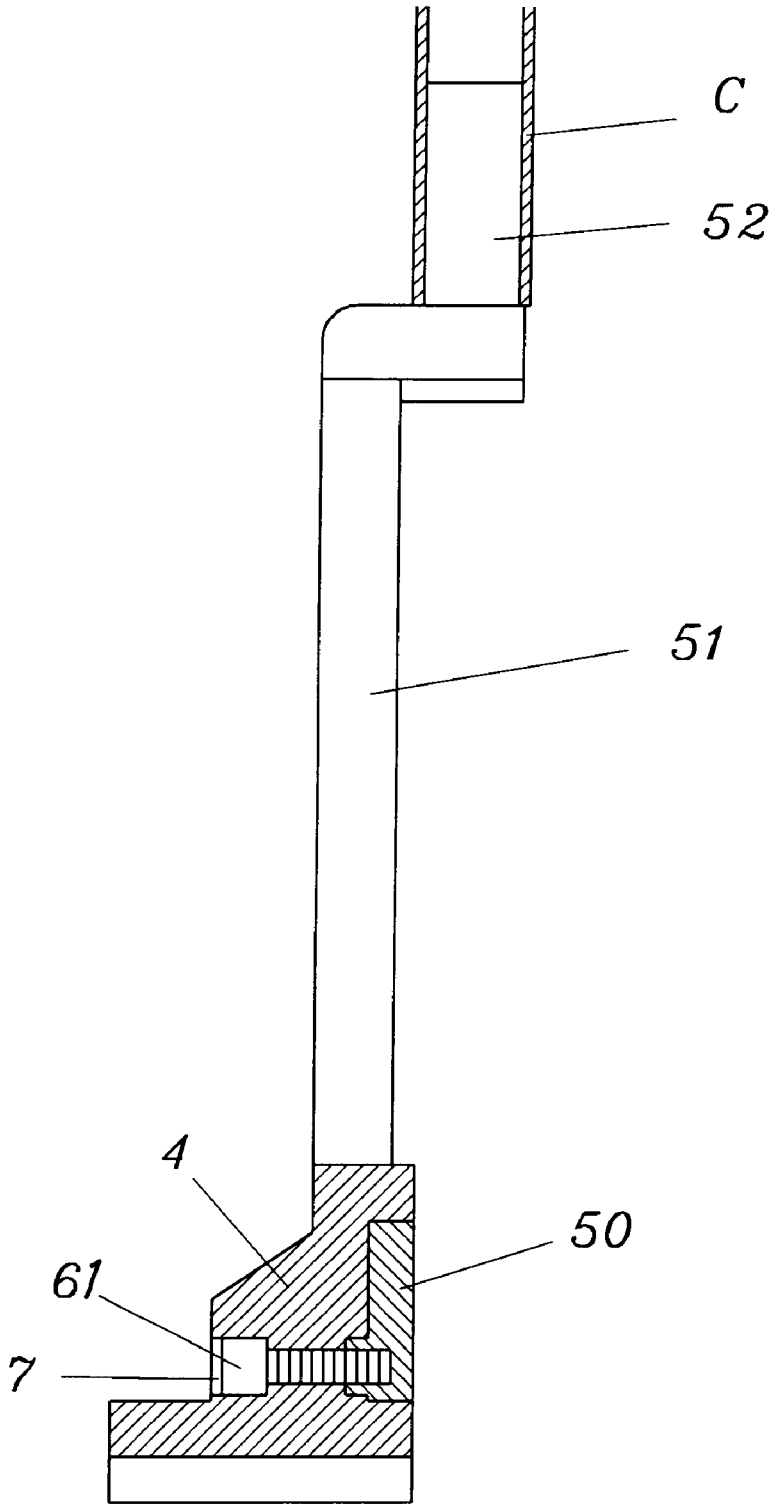
FIG. 12 is a three-dimensional exploded view of a furthermore embodiment of this invention.

As shown in FIG. 11, a further embodiment of this invention is to form a through hole 42 in left end of the concave coupling portion 40 and in the insertion recess 41 of the putter head 4 respectively, and to provide a tapped hole 53 to the striking board 50 and the insertion protrusion 500 respectively in a position corresponding with each through hole 42 in the putter head 4. In combining the striking piece 5 and the putter head 4, a screw joint component 61 is used to penetrate each through hole 42 and get screw-fixed in each tapped hole 53 of the striking board 50 and the insertion piece 500, then a plug 7 is inserted in each through hole 42 (as shown in FIG. 12) to complete another structure of the putter head 4.

A further embodiment of this invention is to use a heavy material in fabricating the striking piece 5 in order to raise up the center of gravity A in the putter head 4 for the golfer who would rather use a putter with relatively higher center of gravity A than a lower one.

From the abovesaid, it is noted that this invention is advantageous in the following:

1. As the striking board and the neck portion are molded integrally with a light material, the center of gravity of the construction will not move upwards after assembly and will remain at same horizontal level with that of a golf ball for easy aligning the sweet spot in a strike.

2. As the two-in-one composition of the striking piece and the putter head by means of binding or screw jointing, this composition will scarcely get loosened in use of during a long period.

3. As the striking board is made of a light material, the reaction force produced in a strike will be absorbed and dispersed by the putter head.

4. The striking board can be made in a heavy material as an option for people who like to use a putter with higher center of gravity in the putter head.

In the above described, at least one preferred embodiment has been elucidated with reference to relating drawings annexed, it is apparent that numerous variations or modifications may be made without departing from the true spirit and scope thereof, as set forth in the following claims.

What is claimed is:

1. A golf putter head, comprising:

a putter head with a concave coupling portion disposed in a front face of said putter heads wherein an insertion recess is formed at a first end of said coupling portion;

a striking piece inserted in said coupling portion having a striking board disposed at a lower end of said striking piece, wherein an insertion protrusion is formed at said first end of said striking board; said insertion protrusion is extended upwards to form a neck portion, whereon a sleeve is provided for coupling with a shaft (C); and said striking board and said neck portion are molded integrally with a light material; and said striking board and said neck portion inserted in said concave coupling portion of said putter head to form a two-in-one composition, wherein said striking board and said neck portion will not move the center of gravity (A) of the putter head upwards substantially to thus provide a golf putter with low center of gravity.

2. The golf putter head according to claim 1, wherein said concave coupling portion and said insertion recess of said putter head are glued with a binder for a compact combination of said striking piece and said putter head to avoid detachment of the same after use in long periods in order not to worsen putting accuracy.

3. The golf putter head according to claim 1, wherein said concave coupling portion and aid insertion recess are provided with a through holes respectively, and a tapped hole is formed in said striking board and said insertion protrusion, respectively; so that, after said striking piece and said putter head are put together, two screw-joint components are used to penetrate said through holes individually from a back portion of said putter head opposite from said striking board to reach said tapped holes and get locked; then, two waterproof plugs are buried in said through holes.

4. The golf putter head according to claim 1, wherein said striking piece is made of a relatively heavier material to raise up the center of gravity (A) of said putter head as an option for people who like to use a putter with a higher center of gravity.

* * * * *